United States Patent [19]

Marcinczyk et al.

[11] Patent Number: 4,480,823

[45] Date of Patent: Nov. 6, 1984

[54] INNERSPRING ASSEMBLY FOR FURNITURE SEATS AND BACKS

[75] Inventors: Henry J. Marcinczyk, Oxford; Ronald J. Gurcew, Southbridge, both of Mass.

[73] Assignee: Webster Spring Co. Inc., Oxford, Mass.

[21] Appl. No.: 429,608

[22] Filed: Sep. 30, 1982

[51] Int. Cl.[3] ..... A47C 23/053

[52] U.S. Cl. ..... 267/91; 5/256; 5/260

[58] Field of Search ..... 267/91-101, 267/103, 106, 110, 111, 112; 5/248, 256, 267, 260

[56] References Cited

U.S. PATENT DOCUMENTS 3,774,248 11/1973 Huras et al. ..... 5/267

4,004,304 1/1977 Kane ..... 5/256 X 4,426,070 1/1984 Garceau et al. ..... 267/91

*Primary Examiner*—Douglas C. Butler

*Attorney, Agent, or Firm*—Robert T. Gammons

[57] ABSTRACT

An innerspring assembly for furniture seats and backs comprising spaced, parallel, substantially rectangular top and bottom grids and tapered helical coils interposed between the grids and secured thereto, the top grid comprising pairs of spaced, parallel anchoring wires which define longitudinally and transversely-spaced seats for receiving the top loops of the coils and the bottom grid comprising anchoring crossing wires which intersect and define seats vertically below the centers of the seats of the top grid for receiving the bottom loops and wherein diametrically-opposed portions of the top and bottom loops overlie the wires of the seats and diametrically-opposed portions of the top and bottom loops at right angles thereto underlie the wires of the seats.

6 Claims, 11 Drawing Figures

INNERSPRING ASSEMBLY FOR FURNITURE SEATS AND BACKS

BACKGROUND OF INVENTION

Customarily, spring assemblies for bottoms and backs of furniture are comprised of wire grid frames—a rigid bottom frame of relatively heavy gauge wire and a rigid top frame of lighter gauge wire between which are secured tapered helical coils, the top loops of which are of larger diameter than the bottom loops. The respective frames are structured to provide seats for the tops and bottom loops. Heretofore, the top loops have either been fixed to the wires of the seats with fastening elements, for example, clips and/or twists of wire or structured to be interlocked with each other without the aid of fastening elements. The bottom loops, however, are attached by means of fastening elements. The present invention has for its purpose to provide an improved structure wherein both the bottom and top loops are structured to be interengaged with the wires of the seat without the aid of fastening elements and in such a way as to facilitate assembly and immobilize the springs relative to the frames.

SUMMARY OF INVENTION

As herein illustrated, the innerspring assembly for furniture seats and backs of this invention comprises spaced, parallel top and bottom wire grid frames and coiled springs interposed between the grid frames and secured thereto, said top grid frame comprising a border wire defining a rectangular frame and pairs of longitudinally and transversely-extending, right-angularly crossing anchor wires secured at their ends to the border wire and to each other at their crossing, said crossing pairs of anchoring wires defining longitudinally and transversely-spaced, substantially rectangular seats for the top loops of the coils, said bottom grid frame comprising a border wire defining a rectangular frame and transversely and longitudinally-extending anchoring wires secured at their ends to the border wire of the bottom grid frame and to each other at their crossings and so positioned in the bottom grid frame that their crossing define seats for the lower ends of the coils situated vertically below the centers of the seats in the top grid frame, said coils tapering from top to bottom and being positioned with the top loops in engagement with the seats of the top grid frame with two of their diametrically-opposite portions below the anchoring wires of the top grid frame and the two at right angles thereto above and with the bottom loops in engagement with the seats of the bottom grid frame with two diametrically-opposed portions above the wires of the seats of the bottom grid frame and the two at right angles thereto below the other of the wires of the seats of the bottom grid frame. Desirably, two of the parallel wires in each of the seats of the top grid frame contain longitudinal deviations for receiving the diametrically-opposed arcuate portions of the top loops and, preferably, these deviations are downward with respect to the plane defined by the wires. The wires of the crossing wires defining the seats of the bottom grid which are above the bottom loops contain deviations which extend downwardly into the loops below the wires which are below the bottom loops.

BRIEF DESCRIPTION OF THE DRAWINGS

The invention will now be described in greater detail with reference to the accompanying drawings, wherein.

Figure 1:
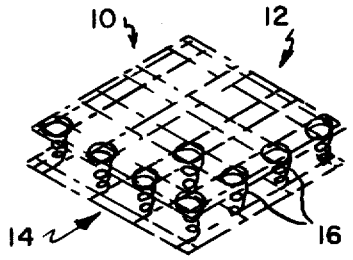
FIG. 1 is a perspective view of the innerspring assembly.

Referring to the drawings, the assembly 10 comprises generally an upper grid frame 12 and a lower grid frame 14 supported in spaced, parallel relation to each other by a plurality of coiled springs 16, the upper ends of which are attached to the upper grid frame and the lower ends of which are attached to the lower grid frame, as will appear hereinafter.

Figure 2:
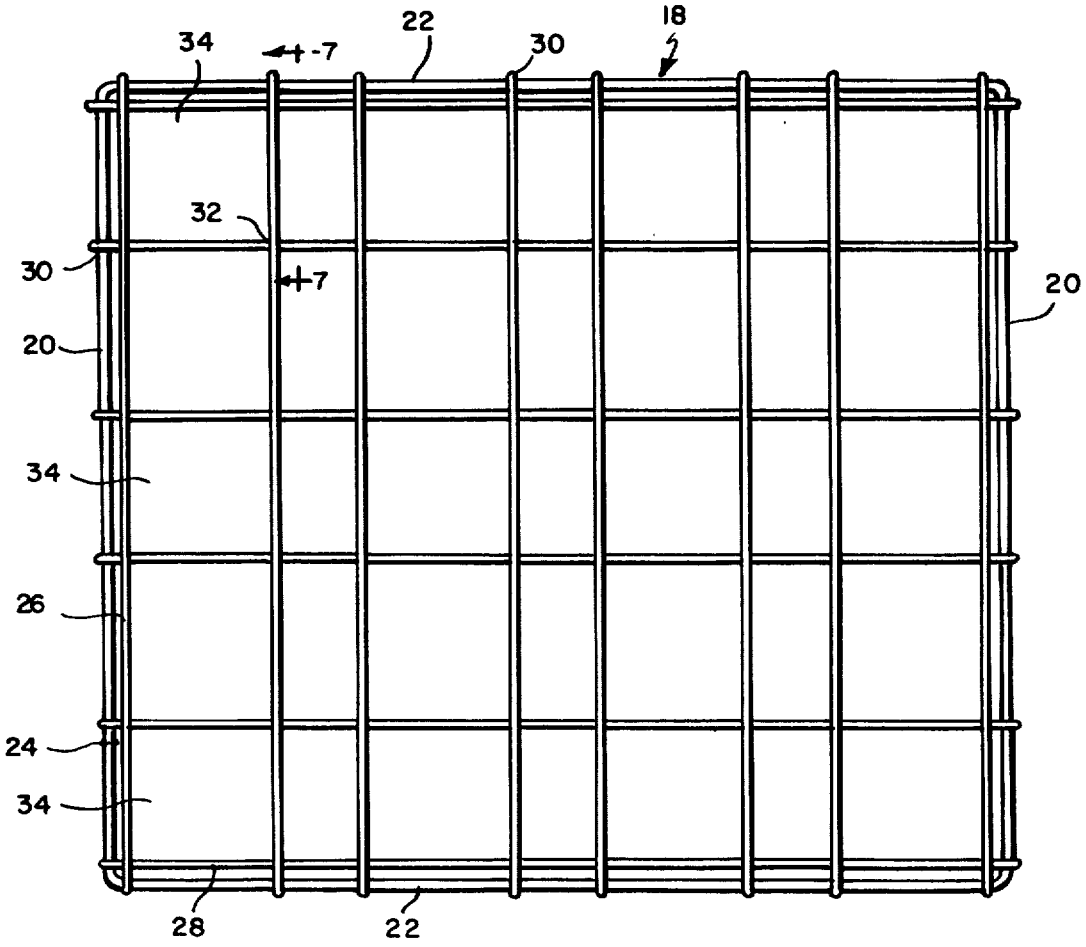
FIG. 2 is a plan view of the upper grid of the assembly.
Figure 3:
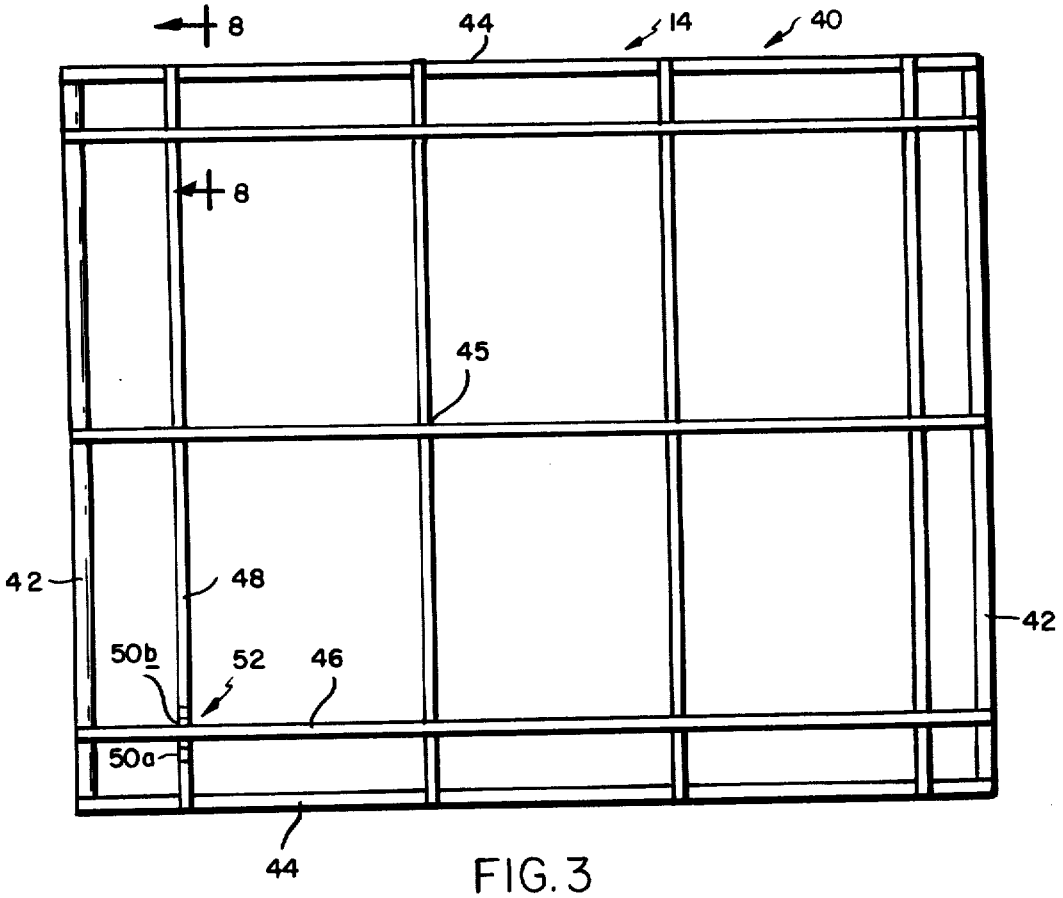
FIG. 3 is a plan view of the lower grid of the assembly.
Figure 4:
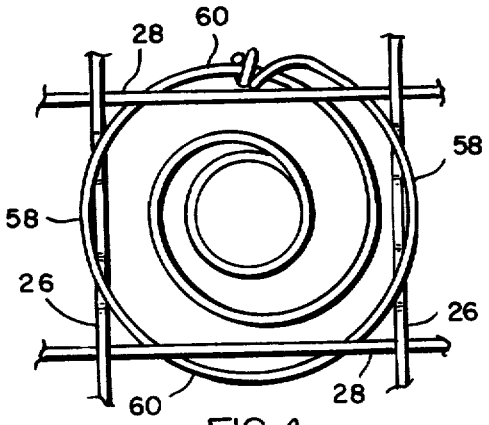
FIG. 4 is an enlarged portion of the upper grid assembly showing the engagement of the upper loop of the spring therewith.
Figure 7:
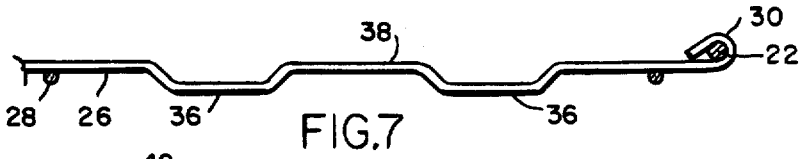
FIG. 7 is a fragmentary elevation taken on the line 7—7 of FIG. 2 showing the structure for attaching the top loops of the coils to the top grid.

The upper grid frame 12, FIG. 2, comprises a border wire 18 having spaced, parallel sides 20—20 and spaced, parallel ends 22—22. The border wire is comprised of relatively stiff gauge wire and, preferably, is formed of a single piece of wire bent to rectangular configuration with the ends joined by welding as shown, for example, at 24. Spaced, parallel grid wires 26 and 28 are attached to the sides and ends 20 and 22 of the border wire 18. The wires 26 cross the wires 28 at right angles. The ends of these wires are attached to the border wire by loops 30. The wires 26 and 28 are welded to each other at their crossings as indicated at 32. The wires are so positioned that right-angularly crossing pairs of wires 26—26 and 28—28 define substantially rectangular seats 34 for receiving the top loops of the coils. The distance between the pairs of wires making up the seats are less than the diameter of the top loops of the coils and the pairs of wires are so positioned that the seats are distributed in substantially equally-spaced positions longitudinally and transversely of the grid frame. Two of the wires at each seat, to wit, the wires 26—26 contain longitudinally-spaced, downwardly-displaced deviations 36 between which there is an undeviated portion 28, FIG. 7. The wires 28 at right angles thereto are uniformly straight, containing no such deviations.

Desirably, both the wires 26 and the wires 28 are of smaller gauge than the wire of the border wire and are positioned at the underside of the border wires so that the loops at the ends are bent upwardly over the top side of the border wire.

In the form of the invention illustrated herein, there are three rows of seats 34, two of which are adjacent the opposite longitudinal sides and the other of which is midway between. Transversely of the frame, there are four rows of transversely-spaced seats, two of which are adjacent the ends and the other two equally spaced therebetween. The number of seats can be more or less than illustrated, depending upon the size of the assembly and the intended use.

Figure 8:
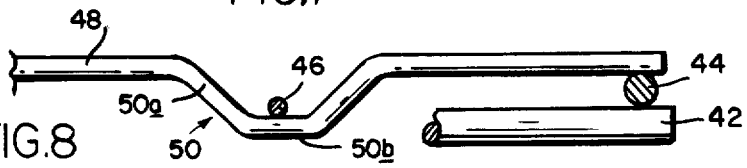
FIG. 8 is a fragmentary elevation taken on the line 8—8 of FIG. 3 showing the structure provided for attaching the bottom loops of the coils to the bottom grid.

The lower grid frame 14 comprises a border wire 40 made up of four lengths of rigid wire comprising two lengths 42—42 which define the sides and two lengths 44—44 which define the ends. The ends of the sides 42—42 underlie the ends of the ends 44—44 and are welded thereto. The lower grid frame is provided with spaced, parallel anchoring wires 46 of which three are shown herein, two adjacent the opposite ends 44 and one intermediate the two and four spaced, parallel wires 48, two of which are adjacent the sides and the other two of which are spaced at equal distances therebetween. The wires 46 and 48 are welded at their ends to the ends and sides 44 and 42 of the border wire and to each other at their crossings 45 and are so positioned in relation to the seats 34 in the upper grid frame that the crossings 45 are vertically below the centers of the seats in the top grid for the purpose of supporting the lower ends of the coils, as will appear hereinafter. The wires 46 are welded at their ends to the top of the wires 42 and the wires 48 are welded at their ends to the top side of the wires 44 so that the wires 48 are situated in a plane above the plane of the wires 46. At the intersections of the wires, FIG. 8, the wires 48 contain downwardly-displaced deviations 50. The deviations 50 have downwardly-converging sides **50*a*—50*a* joined at their lower ends by a bottom 50*b* which underlies the wire 48 and, in conjunction with the wires 46, provide seats 52** for the lower loops of the springs when the latter are positioned between the grids to lock the coils in place.

Figure 6:
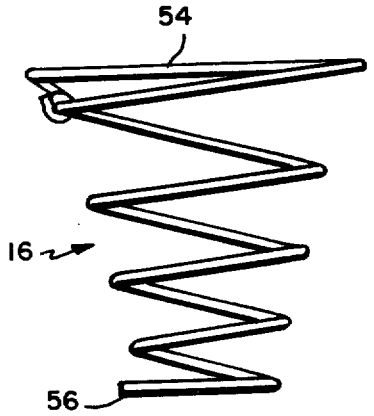
FIG. 6 is an elevation of a spring.
Figure 5:
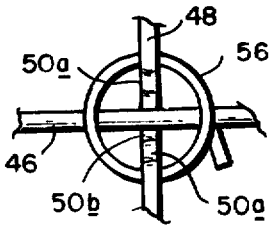
FIG. 5 is an enlarged view of the lower grid showing the attachment of the lower loop of the spring thereto.

Each coil 16, FIG. 6, is in the form of a helix of wire which tapers from a large diameter loop 54 at the top to a small diameter loop 56 at the bottom.

Figure 9:
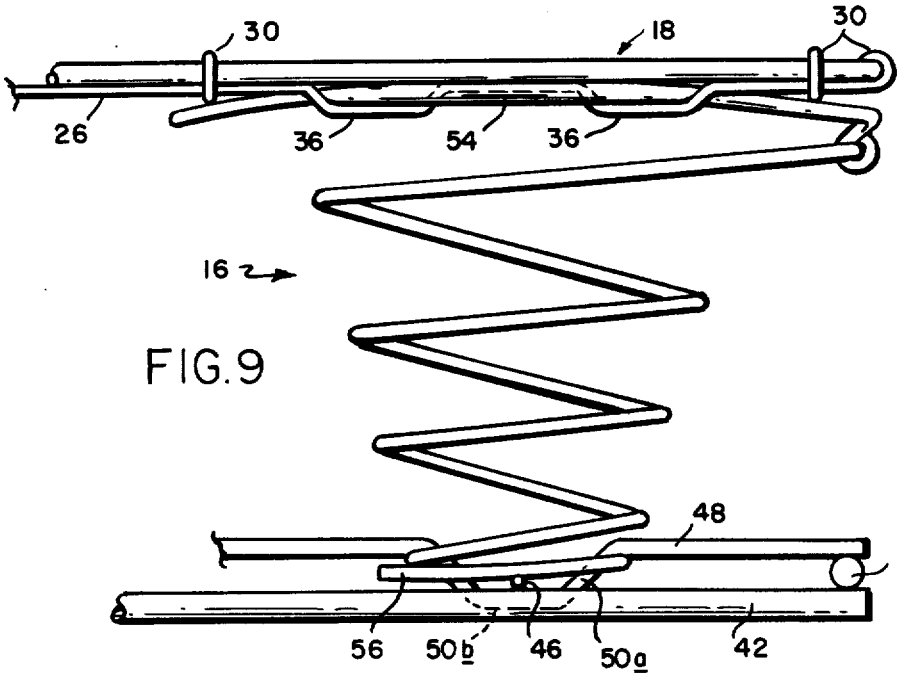
FIG. 9 is an end elevation.
Figure 10:
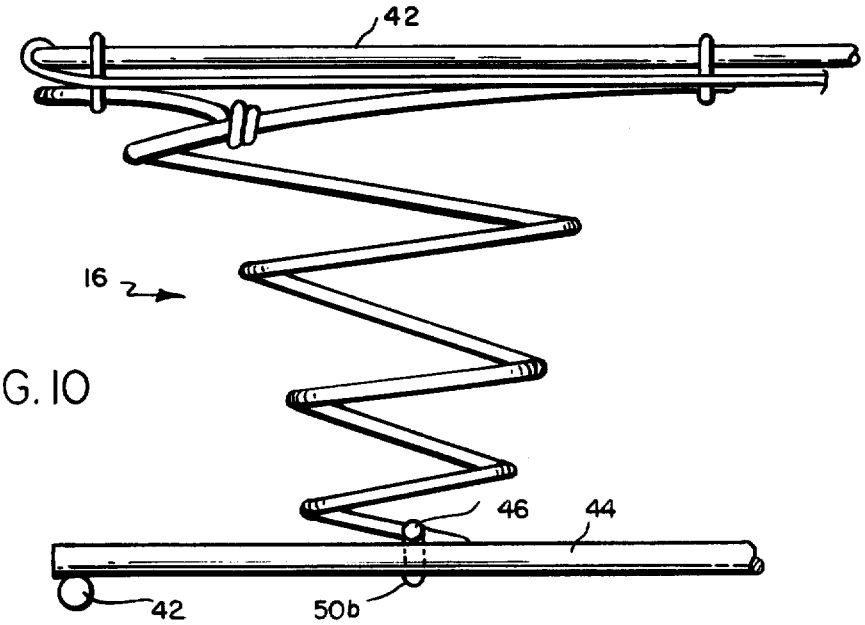
FIG. 10 is a side elevation.

The coils 16 are positioned between the grid frames with the upper loops 54 engaged with the seats 34 and the lower loops 56 engaged with the seats 52. The engagement of the upper loops 54 with the seats 34 is one in which two of the diametrically-opposite arcuate portions 58—58 are positioned above the wires 26—26 and the two at right angles thereto 60—60 are engaged with the lower side of the wires 28. The arcuate portions 58—58 are not only engaged with the upper side of the wires 26—26 but within the deviations 36—36 of each of the wires 26—26. The lower loop 56 is correspondingly engaged at diametrically-opposed sides, at an upper side by one of the crossing wires 48 and at the lower side by the other of the crossing wires 46. The deviations 52, as shown in FIGS. 9 & 11, project downwardly into the lower loops and are dimensioned to be wedged into the lower loops and to be held wedged in by the wires 46.

Figure 11:
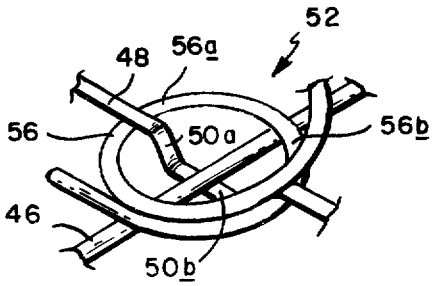
FIG. 11 is a perspective view of the anchoring of the lower end of the coil to the bottom grid.

Referring specifically to FIG. 11, the bottom loops 56 have diametral portions **56*a*—56*a* which abut the underside of the wire 48 and diametral portions 56*b*—56*b* at right angles thereto which abut the upper side of the wire 48**, thus locking the bottom loop in position.

The grid frame wires 42,44 of the bottom grid frame are 3 gauge and the anchoring wires 46,48 are 9 gauge. The border wire 18 of the top grid frame is 6 gauge and the anchoring wires 26,28 of 13 gauge. The coils are of 9 gauge wire.

As thus described, the coils are locked securely to the respective grid frames so as to resist detachment therefrom and to resist rotation about their vertical axis.

The entire assembly, being comprised of wire, can be readily and quickly manufactured by simple cutting and welding practice and, by choosing the proper gauge of the wire for the various components making up the grid frames, grid wires and coils, a structure can be manufactured which will withstand abuse without failure.

It should be understood that the present disclosure is for the purpose of illustration only and includes all modifications or improvements which fall within the scope of the appended claims.

What is claimed is:

1. An innerspring assembly for furniture seats and backs comprising spaced, parallel top and bottom grid frames and coiled springs interposed between the grid frames and secured thereto, said top grid frame comprising a border wire defining a rectangular frame and pairs of longitudinally and transversely-extending, right-angularly crossing anchoring wires secured at their ends to the border wire and to each other at their crossings, said crossing pairs of anchoring wires defining longitudinally and transversely-spaced, substantially rectangular seats for the top loops of the coils, said bottom grid frame comprising a border wire defining a rectangular frame and transversely and longitudinally-extending, spaced, parallel anchoring wires welded at their ends to the border wire of the bottom grid frame and to each other at their crossings and so positioned on the bottom frame that their crossings define seats for the loops at the lower ends of the coils situated vertically below the centers of the seats defined by the anchoring wires of the top grid frame, said coils tapering from top to bottom and being positioned with the top loops in engagement with the seats at the top grid frame with two of their diametrically-opposed arcuate portions below the anchoring wires of the top grid frame and two above, with the bottom loops in engagement with the seats of the bottom grid frame with two of their diametrically-opposite portions above one of the wires of the seats of the bottom grid frame and with the two diametral portions at right angles thereto below the other of the wires of the seats of the bottom grid frame, wherein one of the anchoring wires on the grid frame contains deviations which extend downwardly through the bottom loops of the coils and having downwardly-converging sides held wedged within the bottom loops by the other of the crossing wires of the seats.

2. An innerspring assembly according to claim 1 wherein two of the parallel wires in each of the seats of the top grid frame contain longitudinally-spaced deviations within which arcuate portions of the top loop of the coil are positioned and wherein one of the anchoring wires of the seats on the bottom grid frame contains deviations which extend downwardly through the bottom loops of the coils.

3. An innerspring assembly according to claim 1 wherein two of the parallel wires in each of the seats of the top grid frame contain longitudinally-spaced, downwardly-displaced deviations within which diametrically-opposed arcuate portions of the top loops are seated and wherein one of the wires in each of the seats of the bottom grid frame is situated above the other and contains a deviation extending downwardly through the loops at the lower ends of the coils below the other of the wires of the seat.

4. An innerspring assembly according to claim 3 wherein the deviations in the wires of the bottom grid are in the wires which traverse the bottom grid frame in the same direction as the wires containing the deviations in the top grid frame.

5. An innerspring assembly according to claim 1 wherein the border wire of the bottom grid frame is comprised of spaced, parallel end and side wires and wherein the end wires are welded at their ends to the top sides of the side wires so as to lie in a plane above the plane of the side wires, wherein the anchoring wires parallel to the end wires are also welded at their ends to the top sides of the side wires and wherein the anchoring wires parallel to the side wires are welded to the top sides of the end wires such as to lie in a plane above the plane of the anchoring wires which are parallel to the end wires so as to define between said crossing anchoring wires in the bottom grid frame a space for receiving the bottom loops of the coils with portions of the anchoring wires above and below the bottom loops and said anchoring wires parallel to the side wires contain deviations which extend downwardly from the plane of said wires through the bottom loops of the coils and beneath the anchoring wires parallel to the end wires.

6. An innerspring assembly for furniture seats and backs comprising spaced, parallel top and bottom grid frames and coiled springs interposed between the grid frames and secured thereto, said top grid frame comprising a border wire defining a rectangular frame and pairs of longitudinally and transversely-extending, right-angularly crossing anchoring wires secured at their ends to the border wire and to each other at their crossings, said crossing pairs of anchoring wires defining longitudinally and transversely-spaced, substantially rectangular seats for the top loops of the coils, said bottom grid frame comprising a border wire defining a rectangular frame and transversely and longitudinally-extending, spaced, parallel anchoring wires welded at their ends to the border wire of the bottom grid frame and to each other at their crossings and so positioned on the bottom frame that their crossings define seats for the loops at the lower ends of the coils situated vertically below the centers of the seats defined by the anchoring wires of the top grid frame, said coils tapering from top to bottom and being positioned with the top loops in engagement with the seats at the top grid frame with two of their diametrically-opposed arcuate portions below the anchoring wires of the top grid frame and two above, with the bottom loops in engagement with the seats of the bottom grid frame with two of their diametrically-opposite portions above one of the wires of the seats of the bottom grid frame and with the two diametral portions at right angles thereto below the other of the wires of the seats of the bottom grid frame, wherein two of the parallel wires in each of the seats of the top grid frame contain longitudinally-spaced deviations within which arcuate portions of the top loop of the coil are positioned and wherein one of the anchoring wires of the seats at the bottom grid frame contains downwardly-extending deviations having downwardly-converging sides held wedged within the bottom loops by the other of the crossing wires of the seats.

* * * * *